United States Patent [19]

Stadigh

[11] 3,983,519

[45] Sept. 28, 1976

[54] ELECTROMAGNET

[75] Inventor: Hans-Göran Stadigh, Undersaker, Sweden

[73] Assignee: Linden-Alimak AB, Skelleftea, Sweden

[22] Filed: Apr. 18, 1975

[21] Appl. No.: 569,424

Related U.S. Application Data

[63] Continuation of Ser. No. 449,882, March 11, 1974, abandoned.

[30] Foreign Application Priority Data

Mar. 9, 1973 Sweden ..... 7303335

[52] U.S. Cl. ..... 335/151; 335/154

[51] Int. Cl.[2] ..... H01H 51/28

[58] Field of Search ..... 335/152, 154, 151, 236, 335/153, 301, 91

[56] References Cited

UNITED STATES PATENTS 3,359,463 12/1967 Jones, Jr. ..... 335/152

*Primary Examiner*—Harold Broome

*Attorney, Agent, or Firm*—Pollock, Vande Sande & Priddy

[57] ABSTRACT

An electromagnet comprises a coil core of ferromagnetic material having a coil wound around the core. The coil is supported by a bobbin. The coil core is elongated, and the winding of the coil surrounds the core in its longitudinal direction, so that a homogeneous magnetic field extending between the longitudinally running end surfaces of the coil core is obtained along the length of the whole coil core. A touch free influence of magnetic field controlled means, such as reed switches, positioned along the length of the coil at one of its long sides provided with a winding being obtained, so that for influencing, said means can take a position relative to the magnet within a considerable margin determined by the length of the long sides of the magnet.

5 Claims, 4 Drawing Figures

ELECTROMAGNET

Figure 1:
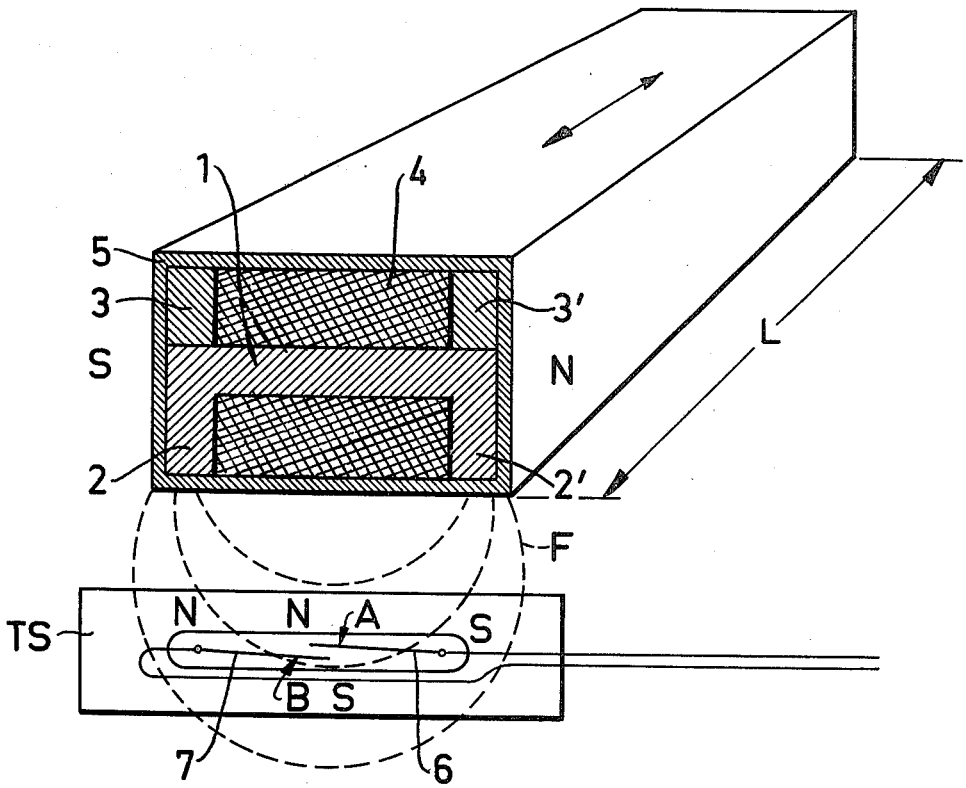

This is a continuation of application Ser. No. 449,882 filed March 11, 1974 and now abandoned.

The present invention relates to an electromagnet comprising a coil core of ferro-magnetic material with a coil wound around the core, which coil is supported by a bobbin.

Often one has a need for touch free control between two means, which are movable in relation to each other, and where control is desired, when the two means take a position within certain margins in relation to each other. In these cases it is suitable to selectively control magnetic field controlled elements placed on one of the means, for instance reed switches, by a directed, well defined magnetic field from the other means, which elements will be closed, when they are placed in a magnetic field, as well as magnetic field controlled semi-conductor elements. In this respect it has been found, that it is rather difficult to provide a controllable magnetic field, which is homogeneous over the whole region, in which the magnetic field controlled elements can be arranged in relation to that means, on which the magnetic field generating element is placed. Furthermore the magnetic field generating element must provide a secure operating function, even when one must have a certain range between the two means. A specific application in which this absolutely must be true is in elevators, where it is desired to control for instance electromechanical door locks, door machineries etc. by directed magnetic fields and magnetic field controlled elements. In this respect for instance the magnetic field generating element both for security reasons and for economical reasons should be placed on the elevator cage, and the magnetic field controlled elements ought to be placed in the elevator shaft at each holding floor.

In elevators it is also important that the magnetic field has a certain extension in the moving direction of the elevator, so that the alignment between the magnetic field generating element and the magnetic field controlled elements does not turn out to be critical, and that instead the elevator has a certain holding zone at each holding floor, in which it is meant to be stopped. When the elevator does not stop exactly in alignment with a holding floor, this is due to the fact, that variation of the braking length occurs owing to brake wear, cable stretch, the setting of the impulse generator etc.

It has not been possible to realize earlier attempts to control for instance locking elements in elevators in the above stated manner just owing to the difficulties of producing a magnetic field with their characteristics and with a sufficient extension in the longitudinal direction. This problem has now been overcome in that the inventive electromagnet has an elongated coil core, and that the winding of the coil surrounds the core in its longitudinal direction, so that a homogeneous magnetic field extending between the longitudinally running end surfaces of the coil core is obtained along the length of the whole coil core, a touch free influence of magnetic field controlled means positioned along the length of the coil at one of its long sides provided with a winding being obtained, so that for influencing, said means can take a position relative to the magnet within a considerable margin determined by the length of the long sides of the magnet.

Usually reed switches are controlled by permanent magnets, but as the magnet field from such elements is not controllable, they are not practical for use in the applications mentioned above. A so-called electromagnetic clamping rod, which is composed of an elongated, oval winding, which is placed around the center leg of a magnetic body with E-formed section can certainly be used with good results. The magnetic field is in this case extended from the outer legs to the center leg of the E or vice versa depending upon the direction of the current in the winding. In this respect it can be arranged that the magnetic field controlled element will be aligned straight opposite a winding half, which is placed between one of the outer legs and the center leg of the E. However, this electromagnetic clamping rod requires twice as much power as the inventive electromagnet for the same function and is accordingly uneconomical.

A specific advantage of the inventive electromagnet is obtained, if the end surfaces of the bobbin partly are formed of ferromagnetic portions, of which one end is in intimate contact with the coil core and the other end forms two poles of the electromagnet, which poles are extended along the long side of the coil and have at least the same extension as the coil core, in which case the magnetic field at a certain distance from the magnet is getting stronger along that longside, along which the ferromagnetic parts are extended, than along the opposite winding half. Thus it can be said that the magnetic field is conducted towards this side.

The ferromagnetic portions can either be integrated parts of the magnetic core or separate parts. Moreover the end surfaces can partly consist of non-magnetic material, so that a symmetrical coil body is formed, the winding of the coil thus being facilitated.

Figure 2:
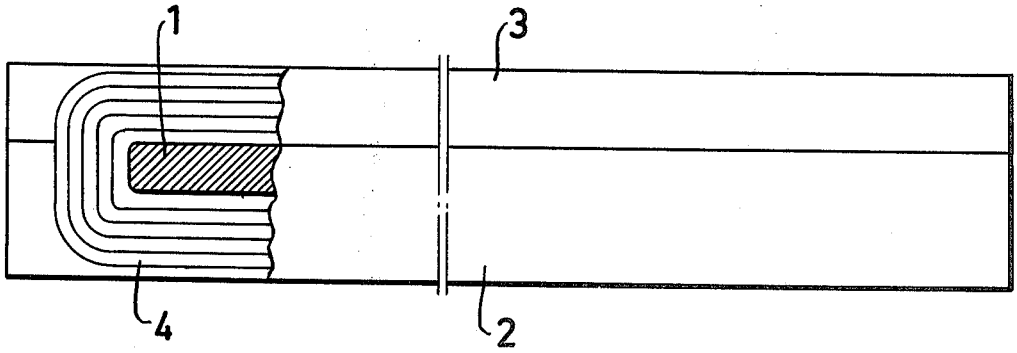
Figure 3:
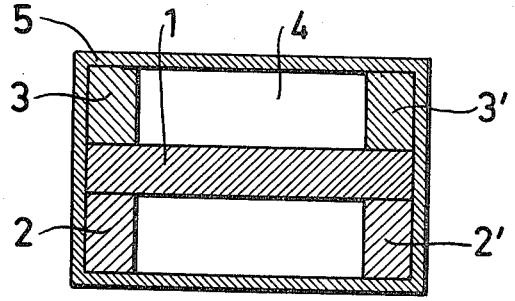
Figure 4:
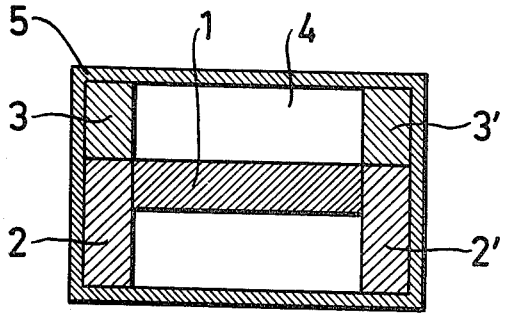

A more detailed description of the invention is given with reference to the accompanying drawings of which FIG. 1 shows a section, partly in perspective view, of an embodiment of the inventive electromagnet, which operates a reed switch, FIG. 2 shows a side view, partly in section, of the electromagnet according to FIG. 1 without a housing, and FIGS. 3 and 4 show two different embodiments of the inventive electromagnet.

FIGS. 1 and 2 show an embodiment of the inventive magnet.

FIG. 1 shows a principal view with drawn magnetic field lines F from the electromagnet, which lines operate a reed switch. For better clearness the switch is showed in open condition instead of closed condition motivated by the magnetic field. FIG. 2 shows a side view, partly in section, of the magnet according to FIG. 1 without the housing. A winding 4 is wound around a discshaped coil core 1 of ferromagnetic material, which core is elongated in the transverse cross section of the coil, so that the winding of the coil will be elongated and oval. In this manner a nearly homogeneous magnetic field is obtained along the long side L of the electromagnet. By right dimensioning of the transverse section area and the length of the coil body the strength of the magnetic field can be obtained as decided and its desired extension in the longitudinal direction can be achieved.

The coil core 1 is at its end surfaces provided with ferromagnetic portions 2, 2′, of which one end is in intimate magnetic contact with the coil core 1 and the other end is forming two poles of the electromagnet and is extended along the whole coil core. According to this embodiment the ferromagnetic portions 2, 2' have a longer extension than the coil core 1 to protect the winding and to obtain a longer homogeneous magnetic field. The ferromagnetic portions 2, 2' cause the magnetic field substantially to be conducted towards that side, where the end surfaces of the coil body consists of ferromagnetic material, such as iron. This causes the magnetic field to be more well-defined and concentrated to a region outside the surface of the coil, as the magnetic field lines are conducted out of the coil body more than if the ferromagnetic end surface parts had not been there. Also the electromagnet is provided with a surrounding housing, for instance of aluminium.

In the embodiment according to FIG. 1 the ferromagnetic portions 2, 2' are arranged as integrated parts of the coil core, and thereby the ferromagnetic core has the form of U-beam, where the center section of the U is cuttered away at the end parts. Other embodiments with the portions affixable on the ferromagnetic core are possible, as is shown in FIGS. 3 and 4. In the latter case, in manufacture a separately wound coil can first be put on the ferromagnetic core, after which the ferromagnetic portions are fixed to the core.

To facilitate the winding of the coil, when the coil core is formed as a U-beam, non-magnetic rods 3, 3' are arranged in the prolongation of the legs of the U at the end facing the coil core, which rods extend along the length of the electromagnet and have substantially the same extension as the portions 2, 2'. Owing to this a symmetrical coil body is obtained.

FIG. 1 shows also a reed switch of a type already known in the magnetic field, which has been marked with the field lines F. The switch is for better illustration erroneously showed in open condition but with force arrows A and B, which mark the direction of the forces to which the elastic reed elements 6 and 7 of ferromagnetic material in the reed switch are exposed under the influence of the magnetic field.

Instead of a magnetic field controlled reed switch can of course any of a magnetic field controllable element be put under the effect of the magnetic field of the inventive electromagnet, for instance a magnetic field controlled semi-conductor element.

When the electromagnet according to the invention is used in elevators the coil core 1 ought to have at least the same length as the holding zone of the elevator. The electromagnet is in this case placed so that it is extended in the moving direction of the elevator and so that the coil core covers the whole holding zone, which is obtained due to occurring variations of the braking length of the elevator due to brake wear, cable stretch, the setting of the impulse generator etc.

What is claimed is:

1. In apparatus for generating a distinctive signal when an electromagnetic device and a magnetic responsive means are moved relative to each other into a magnetic coupling relationship wherein:

said electromagnetic device includes a ferromagnetic core of generally U-shaped cross-section which is elongated in the direction normal to said U-shaped cross-section.

and a coil wound about said core with the turns thereof encircling the bight portion of said core and lying generally parallel to the leg portions of said U-shaped core to provide when energized a magnetic field of flux lines extending between the free ends of said leg portions which field is substantially uniform over the entire length of said core, said magnetic responsive means and said electromagnetic device being movable relative to each other in a direction parallel to that of the turns of said coil, and thus transversely to the direction of the flux lines, into and out of said magnetic coupling relationship, said magnetic responsive means when in its magnetic coupling relationship with said electromagnetic device being on the side of said U-shaped core towards which the legs of the U are directed, said magnetic responsive means providing said distinctive signal when said magnetic responsive means is in magnetic coupling relationship with said electromagnetic device.

2. The apparatus of claim 1 wherein said responsive means includes at least one reed switch.

3. The apparatus of claim 1 wherein the leg portions of said U-shaped core are integral with the bight portion of said U-shaped core.

4. The apparatus of claim 1 wherein the leg portions of said U-shaped core each comprise a separate element which is secured to the bight portion of said U-shaped core.

5. The apparatus of claim 1 wherein said core further includes non-magnetic, elongate leg portions extending over the length of said U-shaped core and so disposed as to form opposing leg portions lying generally opposite to the legs of said U-shaped core.

* * * * *